US010209653B2

(12) United States Patent
Fuse

(10) Patent No.: US 10,209,653 B2
(45) Date of Patent: Feb. 19, 2019

(54) IMAGE PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hiroyuki Fuse, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/928,381

(22) Filed: Mar. 22, 2018

(65) Prior Publication Data

US 2019/0025741 A1 Jan. 24, 2019

(30) Foreign Application Priority Data

Jul. 19, 2017 (JP) ..... 2017-140403

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2078
See application file for complete search history.

(56) References Cited

U.S. PATENT DOCUMENTS 7,511,727 B2 3/2009 Nishida
8,103,183 B2 * 1/2012 Nemoto ..... G03G 15/2039 399/67
8,521,049 B2 * 8/2013 Chosokabe ..... G03G 15/2039 399/67
9,575,456 B2 * 2/2017 Itoh ..... G03G 15/2039
2006/0204266 A1 9/2006 Watabe
2016/0327898 A1 11/2016 Fujiwara et al.
2017/0090360 A1 3/2017 Iwamoto

FOREIGN PATENT DOCUMENTS

EP 0797130 A2 9/1997
EP 3109710 A1 12/2016

OTHER PUBLICATIONS

U.S. Appl. No. 15/694,349, filed Sep. 1, 2017.
Extended European Search Report dated Oct. 11, 2018 in corresponding European Patent Application No. 18182187.7, 10 pages.

* cited by examiner

*Primary Examiner* — Hoang Ngo
(74) *Attorney, Agent, or Firm* — Kim & Stewart LLP

(57) ABSTRACT

An image processing apparatus comprises a heat roller configured to heat a sheet with heat generated by a plurality of heat generating elements and a controller configured to control a current supplied to the heat generating elements from an AC power supply. The controller controls a timing at which the current flows or does not flow to the heat generating elements according to a first set of control parameters, such that a total of a first sum of estimated absolute value magnitudes of a positive polarity current flowing to the heat generating elements during one duty cycle and a second sum of estimated absolute value magnitudes of a negative polarity current flowing to the heat generating elements during the one duty cycle, is lower when the heat generating elements are controlled according to the first set relative when the heat generating elements are controlled according to other sets.

15 Claims, 13 Drawing Sheets

902

| ON/OFF DUTY | STEP | | | | | | | | | |
|---|---|---|---|---|---|---|---|---|---|---|
| | 1 | 2 | 3 | 4 | 5 | 6 | 7 | 8 | 9 | 10 |
| 100% | 1 | -1 | 1 | -1 | 1 | -1 | 1 | -1 | 1 | -1 |
| 90% | 0 | -1 | 1 | -1 | 1 | -1 | 1 | -1 | 1 | -1 |
| 80% | 0 | -1 | 1 | -1 | 1 | 0 | 1 | -1 | 1 | -1 |
| 70% | 0 | -1 | 1 | 0 | 1 | -1 | 0 | -1 | 1 | -1 |
| 60% | 0 | -1 | 0 | -1 | 1 | 0 | 1 | 0 | 1 | -1 |
| 50% | 0 | -1 | 0 | -1 | 0 | -1 | 0 | -1 | 0 | -1 |
| 40% | 0 | 0 | 1 | 0 | 1 | 0 | 0 | -1 | 0 | -1 |
| 30% | 0 | 0 | 0 | -1 | 0 | 0 | 1 | 0 | 0 | -1 |
| 20% | 0 | 0 | 0 | 0 | 1 | 0 | 0 | 0 | 0 | -1 |
| 10% | 0 | 0 | 0 | 0 | 1 | 0 | 0 | 0 | 0 | 0 |
| 0% | 0 | 0 | 0 | 0 | 0 | 0 | 0 | 0 | 0 | 0 |

902a

| ON/OFF DUTY | STEP | | | | | | | | | |
|---|---|---|---|---|---|---|---|---|---|---|
| | 1 | 2 | 3 | 4 | 5 | 6 | 7 | 8 | 9 | 10 |
| 100% | 1 | -1 | 1 | -1 | 1 | -1 | 1 | -1 | 1 | -1 |
| 90% | 0 | -1 | 1 | -1 | 1 | -1 | 1 | -1 | 1 | -1 |
| 80% | 0 | -1 | 1 | -1 | 1 | 0 | 1 | -1 | 1 | -1 |
| 70% | 0 | -1 | 1 | 0 | 1 | -1 | 0 | -1 | 1 | -1 |
| 60% | 0 | -1 | 0 | -1 | 1 | 0 | 1 | 0 | 1 | -1 |
| 50% | 0 | -1 | 0 | -1 | 0 | -1 | 0 | -1 | 0 | -1 |
| 40% | 1 | 0 | 1 | 0 | 0 | -1 | 0 | -1 | 0 | 0 |
| 30% | 1 | 0 | 0 | -1 | 0 | 0 | 1 | 0 | 0 | 0 |
| 20% | 1 | 0 | 0 | 0 | 0 | -1 | 0 | 0 | 0 | 0 |
| 10% | 1 | 0 | 0 | 0 | 0 | 0 | 0 | 0 | 0 | 0 |
| 0% | 0 | 0 | 0 | 0 | 0 | 0 | 0 | 0 | 0 | 0 |

FIG.6

| ON/OFF DUTY | STEP | | | | | | | | | |
|---|---|---|---|---|---|---|---|---|---|---|
| | 1 | 2 | 3 | 4 | 5 | 6 | 7 | 8 | 9 | 10 |
| 100% | 1 | 1 | 1 | 1 | 1 | 1 | 1 | 1 | 1 | 1 |
| 90% | 0 | 1 | 1 | 1 | 1 | 1 | 1 | 1 | 1 | 1 |
| 80% | 0 | 1 | 1 | 1 | 1 | 0 | 1 | 1 | 1 | 1 |
| 70% | 0 | 1 | 1 | 0 | 1 | 1 | 0 | 1 | 1 | 1 |
| 60% | 0 | 1 | 0 | 1 | 1 | 0 | 1 | 0 | 1 | 1 |
| 50% | 0 | 1 | 0 | 1 | 0 | 1 | 0 | 1 | 0 | 1 |
| 40% | 0 | 0 | 1 | 0 | 1 | 0 | 0 | 1 | 0 | 1 |
| 30% | 0 | 0 | 0 | 1 | 0 | 0 | 1 | 0 | 0 | 1 |
| 20% | 0 | 0 | 0 | 0 | 1 | 0 | 0 | 0 | 0 | 1 |
| 10% | 0 | 0 | 0 | 0 | 1 | 0 | 0 | 0 | 0 | 0 |
| 0% | 0 | 0 | 0 | 0 | 0 | 0 | 0 | 0 | 0 | 0 |

903

FIG.7

CASE 1 ALL ARE NOT DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | 0 | -2 | 2 | -2 | 2 | 0 | 2 | -2 | 2 | -2 | 0 |
| SECOND LAMP | 600 | 2 | 50% | 0 | -2 | 0 | -2 | 0 | -2 | 0 | -2 | 0 | -2 | 0 |
| THIRD LAMP | 300 | 1 | 90% | 0 | -1 | 1 | -1 | 1 | -1 | 1 | -1 | 1 | -1 | 0 |
| | | | TOTAL (A) | 0 | -5 | 3 | -5 | 3 | -3 | 3 | -5 | 3 | -5 | 0 |

CASE 2 FIRST LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | | 0 | 2 | -2 | 2 | -2 | 0 | -2 | 2 | -2 | 2 |
| SECOND LAMP | 600 | 2 | 50% | 0 | -2 | 0 | -2 | 0 | -2 | 0 | -2 | 0 | -2 | 0 |
| THIRD LAMP | 300 | 1 | 90% | 0 | -1 | 1 | -1 | 1 | -1 | 1 | -1 | 1 | -1 | 0 |
| | | | TOTAL (A) | 0 | -3 | 3 | -5 | 3 | -5 | 1 | -5 | 3 | -5 | 2 |

CASE 3 SECOND LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | 0 | -2 | 2 | -2 | 2 | 0 | 2 | -2 | 2 | -2 | 0 |
| SECOND LAMP | 600 | 2 | 50% | | 0 | 2 | 0 | 2 | 0 | 2 | 0 | 2 | 0 | 2 |
| THIRD LAMP | 300 | 1 | 90% | 0 | -1 | 1 | -1 | 1 | -1 | 1 | -1 | 1 | -1 | 0 |
| | | | TOTAL (A) | 0 | -3 | 5 | -3 | 5 | -1 | 5 | -3 | 5 | -3 | 2 |

CASE 4 THIRD LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | 0 | -2 | 2 | -2 | 2 | 0 | 2 | -2 | 2 | -2 | 0 |
| SECOND LAMP | 600 | 2 | 50% | 0 | -2 | 0 | -2 | 0 | -2 | 0 | -2 | 0 | -2 | 0 |
| THIRD LAMP | 300 | 1 | 90% | | 0 | 1 | -1 | 1 | -1 | 1 | -1 | 1 | -1 | 1 |
| | | | TOTAL (A) | 0 | -4 | 3 | -5 | 3 | -3 | 3 | -5 | 3 | -5 | 1 |

FIG.8

CASE 1 ALL ARE NOT DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | 0 | -2 | 2 | -2 | 2 | 0 | 2 | -2 | 2 | -2 | 0 |
| SECOND LAMP | 600 | 2 | 20% | 0 | 0 | 0 | 0 | 2 | 0 | 0 | 0 | 0 | -2 | 0 |
| THIRD LAMP | 300 | 1 | 50% | 0 | -1 | 0 | -1 | 0 | -1 | 0 | -1 | 0 | -1 | 0 |
| | | | TOTAL (A) | 0 | -3 | 2 | -3 | 4 | -1 | 2 | -3 | 2 | -5 | 0 |

CASE 2 FIRST LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | | 0 | 2 | -2 | 2 | -2 | 0 | -2 | 2 | -2 | 2 |
| SECOND LAMP | 600 | 2 | 20% | 0 | 0 | 0 | 0 | 2 | 0 | 0 | 0 | 0 | -2 | 0 |
| THIRD LAMP | 300 | 1 | 50% | 0 | -1 | 0 | -1 | 0 | -1 | 0 | -1 | 0 | -1 | 0 |
| | | | TOTAL (A) | 0 | -1 | 2 | -3 | 4 | -3 | 0 | -3 | 2 | -5 | 2 |

CASE 3 SECOND LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | 0 | -2 | 2 | -2 | 2 | 0 | 2 | -2 | 2 | -2 | 0 |
| SECOND LAMP | 600 | 2 | 20% | | 0 | 0 | 0 | 0 | -2 | 0 | 0 | 0 | 0 | 2 |
| THIRD LAMP | 300 | 1 | 50% | 0 | -1 | 0 | -1 | 0 | -1 | 0 | -1 | 0 | -1 | 0 |
| | | | TOTAL (A) | 0 | -3 | 2 | -3 | 2 | -3 | 2 | -3 | 2 | -3 | 2 |

CASE 4 THIRD LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | 0 | -2 | 2 | -2 | 2 | 0 | 2 | -2 | 2 | -2 | 0 |
| SECOND LAMP | 600 | 2 | 20% | 0 | 0 | 0 | 0 | 2 | 0 | 0 | 0 | 0 | -2 | 0 |
| THIRD LAMP | 300 | 1 | 50% | | 0 | 1 | 0 | 1 | 0 | 1 | 0 | 1 | 0 | 1 |
| | | | TOTAL (A) | 0 | -2 | 3 | -2 | 5 | 0 | 3 | -2 | 3 | -4 | 1 |

FIG.9

CASE 1 ALL ARE NOT DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 70% | 0 | -2 | 2 | 0 | 2 | -2 | 0 | -2 | 2 | -2 | 0 |
| SECOND LAMP | 600 | 2 | 30% | 0 | 0 | 0 | -2 | 0 | 0 | 2 | 0 | 0 | -2 | 0 |
| THIRD LAMP | 300 | 1 | 60% | 0 | -1 | 0 | -1 | 1 | 0 | 1 | 0 | 1 | -1 | 0 |
| | | | TOTAL (A) | 0 | -3 | 2 | -3 | 3 | -2 | 3 | -2 | 3 | -5 | 0 |

CASE 2 FIRST LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 70% | | 0 | 2 | -2 | 0 | -2 | 2 | 0 | 2 | -2 | 2 |
| SECOND LAMP | 600 | 2 | 30% | 0 | 0 | 0 | -2 | 0 | 0 | 2 | 0 | 0 | -2 | 0 |
| THIRD LAMP | 300 | 1 | 60% | 0 | -1 | 0 | -1 | 1 | 0 | 1 | 0 | 1 | -1 | 0 |
| | | | TOTAL (A) | 0 | -1 | 2 | -5 | 1 | -2 | 5 | 0 | 3 | -5 | 2 |

CASE 3 SECOND LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 70% | 0 | -2 | 2 | 0 | 2 | -2 | 0 | -2 | 2 | -2 | 0 |
| SECOND LAMP | 600 | 2 | 30% | | 0 | 0 | 0 | 2 | 0 | 0 | -2 | 0 | 0 | 2 |
| THIRD LAMP | 300 | 1 | 60% | 0 | -1 | 0 | -1 | 1 | 0 | 1 | 0 | 1 | -1 | 0 |
| | | | TOTAL (A) | 0 | -3 | 2 | -1 | 5 | -2 | 1 | -4 | 3 | -3 | 2 |

CASE 4 THIRD LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 70% | 0 | -2 | 2 | 0 | 2 | -2 | 0 | -2 | 2 | -2 | 0 |
| SECOND LAMP | 600 | 2 | 30% | 0 | 0 | 0 | -2 | 0 | 0 | 2 | 0 | 0 | -2 | 0 |
| THIRD LAMP | 300 | 1 | 60% | | 0 | 1 | 0 | 1 | -1 | 0 | -1 | 0 | -1 | 1 |
| | | | TOTAL (A) | 0 | -2 | 3 | -2 | 3 | -3 | 2 | -3 | 2 | -5 | 1 |

FIG.10

CASE 1 ALL ARE NOT DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | 0 | -2 | 2 | -2 | 2 | 0 | 2 | -2 | 2 | -2 | 0 |
| SECOND LAMP | 600 | 2 | 50% | 0 | -2 | 0 | -2 | 0 | -2 | 0 | -2 | 0 | -2 | 0 |
| THIRD LAMP | 300 | 1 | 90% | 0 | -1 | 1 | -1 | 1 | -1 | 1 | -1 | 1 | -1 | 0 |
| | | | TOTAL (A) | 0 | -5 | 3 | -5 | 3 | -3 | 3 | -5 | 3 | -5 | 0 |

CASE 2 FIRST LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | | 0 | 2 | -2 | 2 | -2 | 0 | -2 | 2 | -2 | 2 |
| SECOND LAMP | 600 | 2 | 50% | 0 | -2 | 0 | -2 | 0 | -2 | 0 | -2 | 0 | -2 | 0 |
| THIRD LAMP | 300 | 1 | 90% | 0 | -1 | 1 | -1 | 1 | -1 | 1 | -1 | 1 | -1 | 0 |
| | | | TOTAL (A) | 0 | -3 | 3 | -5 | 3 | -5 | 1 | -5 | 3 | -5 | 2 |

CASE 3 SECOND LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | 0 | -2 | 2 | -2 | 2 | 0 | 2 | -2 | 2 | -2 | 0 |
| SECOND LAMP | 600 | 2 | 50% | | 0 | 2 | 0 | 2 | 0 | 2 | 0 | 2 | 0 | 2 |
| THIRD LAMP | 300 | 1 | 90% | 0 | -1 | 1 | -1 | 1 | -1 | 1 | -1 | 1 | -1 | 0 |
| | | | TOTAL (A) | 0 | -3 | 5 | -3 | 5 | -1 | 5 | -3 | 5 | -3 | 2 |

CASE 4 THIRD LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 80% | 0 | -2 | 2 | -2 | 2 | 0 | 2 | -2 | 2 | -2 | 0 |
| SECOND LAMP | 600 | 2 | 50% | 0 | -2 | 0 | -2 | 0 | -2 | 0 | -2 | 0 | -2 | 0 |
| THIRD LAMP | 300 | 1 | 90% | | 0 | 1 | -1 | 1 | -1 | 1 | -1 | 1 | -1 | 1 |
| | | | TOTAL (A) | 0 | -4 | 3 | -5 | 3 | -3 | 3 | -5 | 3 | -5 | 1 |

FIG.11

CASE 1 ALL ARE NOT DELAYED BY HALF WAVE

| | ELECTRIC POWER (W) | FACTOR | ON/OFF DUTY | STEP | | | | | | | | | | |
|---|---|---|---|---|---|---|---|---|---|---|---|---|---|---|
| | | | | 0 | 1 | 2 | 3 | 4 | 5 | 6 | 7 | 8 | 9 | 10 |
| FIRST LAMP | 600 | 2 | 70% | 0 | -2 | 2 | 0 | 2 | -2 | 0 | -2 | 2 | -2 | 0 |
| SECOND LAMP | 600 | 2 | 70% | 0 | -2 | 2 | 0 | 2 | -2 | 0 | -2 | 2 | -2 | 0 |
| THIRD LAMP | 300 | 1 | 20% | 1 | 0 | 0 | 0 | 0 | -1 | 0 | 0 | 0 | 0 | 1 |
| | | | TOTAL (A) | 1 | -4 | 4 | 0 | 4 | -5 | 0 | -4 | 4 | -4 | 1 |

CASE 2 FIRST LAMP IS DELAYED BY HALF WAVE

| | ELECTRIC POWER (W) | FACTOR | ON/OFF DUTY | STEP | | | | | | | | | | |
|---|---|---|---|---|---|---|---|---|---|---|---|---|---|---|
| | | | | 0 | 1 | 2 | 3 | 4 | 5 | 6 | 7 | 8 | 9 | 10 |
| FIRST LAMP | 600 | 2 | 70% | | 0 | 2 | -2 | 0 | -2 | 2 | 0 | 2 | -2 | 2 |
| SECOND LAMP | 600 | 2 | 70% | 0 | -2 | 2 | 0 | 2 | -2 | 0 | -2 | 2 | -2 | 0 |
| THIRD LAMP | 300 | 1 | 20% | 1 | 0 | 0 | 0 | 0 | -1 | 0 | 0 | 0 | 0 | 1 |
| | | | TOTAL (A) | 1 | -2 | 4 | -2 | 2 | -5 | 2 | -2 | 4 | -4 | 3 |

CASE 3 SECOND LAMP IS DELAYED BY HALF WAVE

| | ELECTRIC POWER (W) | FACTOR | ON/OFF DUTY | STEP | | | | | | | | | | |
|---|---|---|---|---|---|---|---|---|---|---|---|---|---|---|
| | | | | 0 | 1 | 2 | 3 | 4 | 5 | 6 | 7 | 8 | 9 | 10 |
| FIRST LAMP | 600 | 2 | 70% | 0 | -2 | 2 | 0 | 2 | -2 | 0 | -2 | 2 | -2 | 0 |
| SECOND LAMP | 600 | 2 | 70% | | 0 | 2 | -2 | 0 | -2 | 2 | 0 | 2 | -2 | 2 |
| THIRD LAMP | 300 | 1 | 20% | 1 | 0 | 0 | 0 | 0 | -1 | 0 | 0 | 0 | 0 | 1 |
| | | | TOTAL (A) | 1 | -2 | 4 | -2 | 2 | -5 | 2 | -2 | 4 | -4 | 3 |

CASE 4 THIRD LAMP IS DELAYED BY HALF WAVE

| | ELECTRIC POWER (W) | FACTOR | ON/OFF DUTY | STEP | | | | | | | | | | |
|---|---|---|---|---|---|---|---|---|---|---|---|---|---|---|
| | | | | 0 | 1 | 2 | 3 | 4 | 5 | 6 | 7 | 8 | 9 | 10 |
| FIRST LAMP | 600 | 2 | 70% | 0 | -2 | 2 | 0 | 2 | -2 | 0 | -2 | 2 | -2 | 0 |
| SECOND LAMP | 600 | 2 | 70% | 0 | -2 | 2 | 0 | 2 | -2 | 0 | -2 | 2 | -2 | 0 |
| THIRD LAMP | 300 | 1 | 20% | | -1 | 0 | 0 | 0 | 0 | 1 | 0 | 0 | 0 | 0 |
| | | | TOTAL (A) | 0 | -5 | 4 | 0 | 4 | -4 | 1 | -4 | 4 | -4 | 0 |

FIG.12

CASE 1 ALL ARE NOT DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 70% | 0 | -2 | 2 | 0 | 2 | -2 | 0 | -2 | 2 | -2 | 0 |
| SECOND LAMP | 600 | 2 | 30% | 2 | 0 | 0 | -2 | 0 | 0 | 2 | 0 | 0 | 0 | 2 |
| THIRD LAMP | 300 | 1 | 50% | 0 | -1 | 0 | -1 | 0 | -1 | 0 | -1 | 0 | -1 | 0 |
| | | | TOTAL (A) | 2 | -3 | 2 | -3 | 2 | -3 | 2 | -3 | 2 | -3 | 2 |

CASE 2 FIRST LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 70% | | 0 | 2 | -2 | 0 | -2 | 2 | 0 | 2 | -2 | 2 |
| SECOND LAMP | 600 | 2 | 30% | 2 | 0 | 0 | -2 | 0 | 0 | 2 | 0 | 0 | 0 | 2 |
| THIRD LAMP | 300 | 1 | 50% | 0 | -1 | 0 | -1 | 0 | -1 | 0 | -1 | 0 | -1 | 0 |
| | | | TOTAL (A) | 2 | -1 | 2 | -5 | 0 | -3 | 4 | -1 | 2 | -3 | 4 |

CASE 3 SECOND LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 70% | 0 | -2 | 2 | 0 | 2 | -2 | 0 | -2 | 2 | -2 | 0 |
| SECOND LAMP | 600 | 2 | 30% | | -2 | 0 | 0 | 2 | 0 | 0 | -2 | 0 | 0 | 0 |
| THIRD LAMP | 300 | 1 | 50% | 0 | -1 | 0 | -1 | 0 | -1 | 0 | -1 | 0 | -1 | 0 |
| | | | TOTAL (A) | 0 | -5 | 2 | -1 | 4 | -3 | 0 | -5 | 2 | -3 | 0 |

CASE 4 THIRD LAMP IS DELAYED BY HALF WAVE

| | ELECTRIC POWER (W) | FACTOR | ON/OFF DUTY | STEP 0 | 1 | 2 | 3 | 4 | 5 | 6 | 7 | 8 | 9 | 10 |
|---|---|---|---|---|---|---|---|---|---|---|---|---|---|---|
| FIRST LAMP | 600 | 2 | 70% | 0 | -2 | 2 | 0 | 2 | -2 | 0 | -2 | 2 | -2 | 0 |
| SECOND LAMP | 600 | 2 | 30% | 2 | 0 | 0 | -2 | 0 | 0 | 2 | 0 | 0 | 0 | 2 |
| THIRD LAMP | 300 | 1 | 50% | | 0 | 1 | 0 | 1 | 0 | 1 | 0 | 1 | 0 | 1 |
| | | | TOTAL (A) | 2 | -2 | 3 | -2 | 3 | -2 | 3 | -2 | 3 | -2 | 3 |

IMAGE PROCESSING APPARATUS

CROSS-REFERENCE TO RELATED APPLICATION

This application is based upon and claims the benefit of priority from Japanese Patent Application No. 2017-140403, filed Jul. 19, 2017, the entire contents of which are incorporated herein by reference.

FIELD

Embodiments described herein relate generally to an image processing apparatus.

BACKGROUND

Generally, a temperature control of a fixing device of an image processing apparatus is performed based on two temperature threshold vales, i.e., an upper limit temperature and a lower limit temperature between which good fixing performance can be obtained. In the general temperature control, a heat generating element is controlled to generate heat until a temperature of the fixing device reaches the upper limit temperature, and if the temperature reaches the upper limit temperature, the heat generating element is controlled to stop the heat generation. After the heat generating element stops the heat generation, the temperature starts to fall after overshooting for a while. Even if the temperature falls below the upper limit temperature, the heat generating element is kept OFF, and if the temperature reaches the lower limit temperature, the heat generating element is controlled to generate heat. After the heat generating element is turned on, the temperature starts to rise after undershooting for a while. Even if the temperature becomes higher than the lower limit temperature, the heat generating element is kept ON, and if the temperature reaches the upper limit temperature, the heat generating element is controlled to stop heat generation. By repeating such processing, the temperature of the fixing device is controlled. There is a case in which the upper limit temperature and the lower limit temperature are the same, but in that case as well, the control is performed similarly.

However, with the above temperature control, there is a case that the temperature of the fixing device fluctuates in a wide range and the accuracy of temperature control becomes low. In a case where the upper limit temperature and the lower limit temperature are the same, due to the overshooting and undershooting, there is also a case that the temperature of the fixing device fluctuates in a wide range and the accuracy of temperature control becomes low similarly. In order to reduce the range of the fluctuation of the temperature, a method for controlling the heat generating element at a duty ratio of plural values between 0% and 100% rather than controlling the heat generating element at a duty ratio of 100%, is known.

However, if the heat generating element is controlled according to the duty ratio, there is a case that the amplitude of the higher harmonic waves becomes larger.

DESCRIPTION OF THE DRAWINGS

FIG. 6 is a diagram of a control pattern table stored by a storage section;

FIG. 7 is a diagram of each control pattern table in a first application example;

FIG. 8 is a diagram of each control pattern table in a second application example;

FIG. 9 is a diagram of each control pattern table in a third application example;

FIG. 10 is a diagram of each control pattern table in a fourth application example;

FIG. 11 is a diagram of each control pattern table in a fifth application example;

FIG. 12 is a diagram of each control pattern table in a sixth application example.

DETAILED DESCRIPTION

In accordance with an embodiment, an image processing apparatus comprises a heat roller configured to heat a sheet with heat generated by a plurality of heat generating elements and a controller configured to control a current supplied to the heat generating elements from an AC power supply. The controller controls a timing at which the current flows to the heat generating elements and a timing at which the current does not flow to the heat generating elements according to a first set of stored control parameters that are selected from a plurality of sets of stored control parameters including the first set of stored control parameters and a second set of stored control parameters, such that a total of a first sum of estimated absolute value magnitudes of a positive polarity current flowing to the heat generating elements during one duty cycle of the heat generating elements and a second sum of estimated absolute value magnitudes of a negative polarity current flowing to the heat generating elements during the one duty cycle, is lower when the heat generating elements are controlled according to the first set of stored control parameters relative when the heat generating elements are controlled according to the second set of stored control parameters.

Hereinafter, an image processing apparatus of an embodiment is described with reference to the accompanying drawings.

Figure 1:
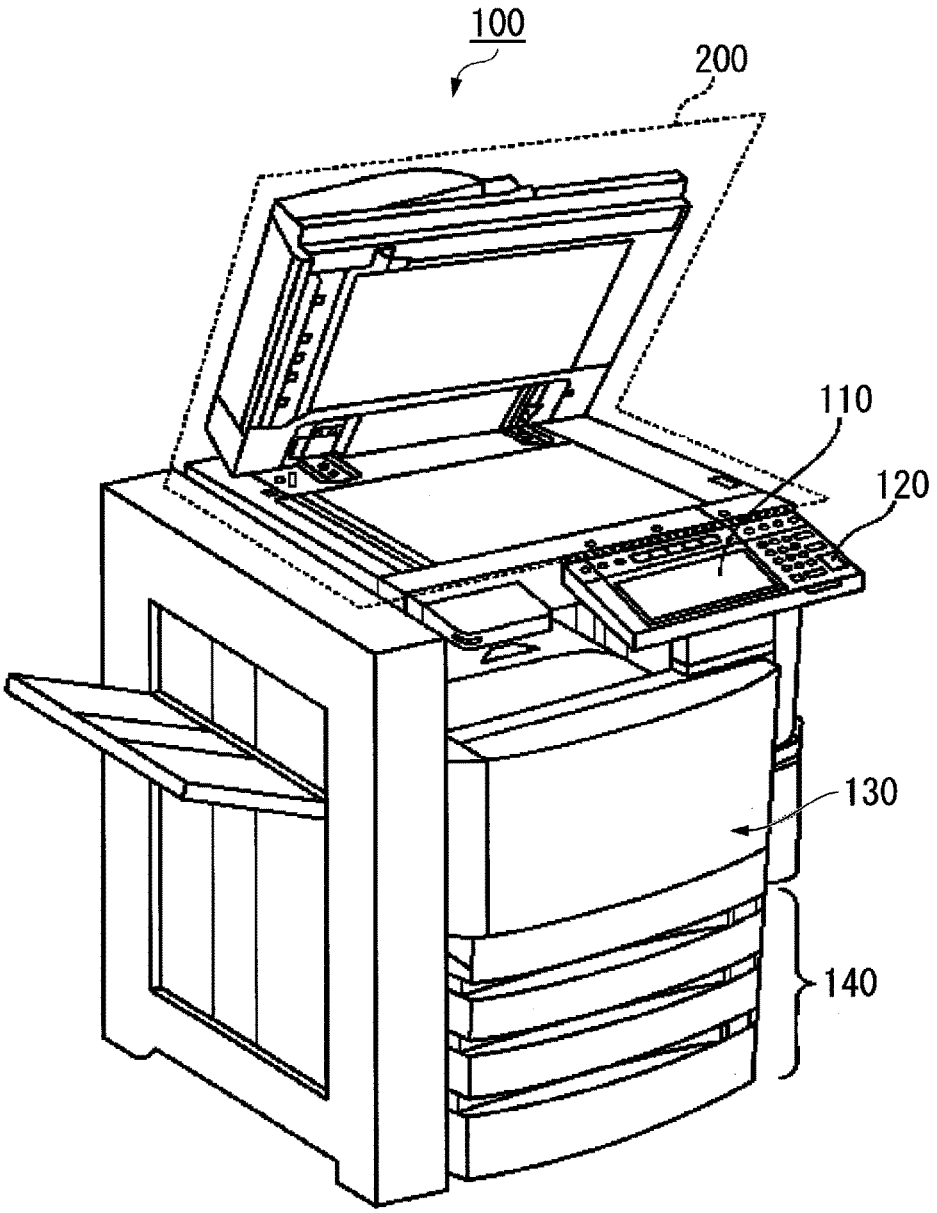
FIG. 1 is an external view of an image processing apparatus according to an embodiment.

FIG. 1 is a schematic diagram of an image processing apparatus 100 according to the embodiment. The image processing apparatus 100 is an apparatus which forms an image on a sheet, such as a multi-functional peripheral. The image processing apparatus 100 also can be an apparatus which decolors an image on a sheet formed with a decolorable toner by applying heat, such as a decoloring apparatus. Hereinafter, a case in which the image processing apparatus 100 is the multi-functional peripheral is described as an example. In a case where the image processing apparatus 100 is a multi-functional peripheral, the image processing apparatus 100 includes a fixing section having the heat generating element therein. However, in a case where the image processing apparatus 100 is the decoloring apparatus, the heat generating element is provided in a decoloring section.

The image processing apparatus 100 includes a display 110, a control panel 120, a printer 130, a sheet housing section 140 and an image reading section 200.

The image processing apparatus 100 forms an image on a sheet using a toner. The sheet is, for example, a paper or a label paper. Any sheet type recording medium can be used for the image formation as long as the image processing apparatus 100 can form an image on a surface thereof.

The display 110 is an image display device such as a liquid crystal display, an organic EL (Electro Luminescence) display and the like. The display 110 displays various information on the image processing apparatus 100.

The control panel 120 includes a plurality of buttons. The control panel 120 receives an operation input by a user. The control panel 120 outputs a signal in response to an operation input executed by the user to a controller of the image processing apparatus 100. Furthermore, the display 110 and the control panel 120 may be constituted as an integrated touch panel.

The printer 130 forms an image on the sheet based on image information generated by the image reading section 200 or image information received through a communication path. The printer 130 forms an image through the following processing, for example. An image forming section of the printer 130 forms an electrostatic latent image on a photoconductive drum based on the image information. The image forming section of the printer 130 forms a toner image by attaching the toner to the electrostatic latent image formed on the photoconductive drum. A transfer section of the printer 130 transfers the toner image onto the sheet. A fixing section of the printer 130 fixes the toner image onto the sheet by heating and pressurizing the sheet. The sheet which is subjected to the image formation may be a sheet housed in the sheet housing section 140, or a sheet that is manually fed.

The sheet housing section 140 houses the sheet subjected to the image formation by the printer 130.

The image reading section 200 reads the image information on a document to be read as intensity of light. The image reading section 200 records the read image information. The recorded image information may be transmitted to another information processing apparatus via a network. The recorded image information may be used to form an image on the sheet by the printer 130.

Figure 2:
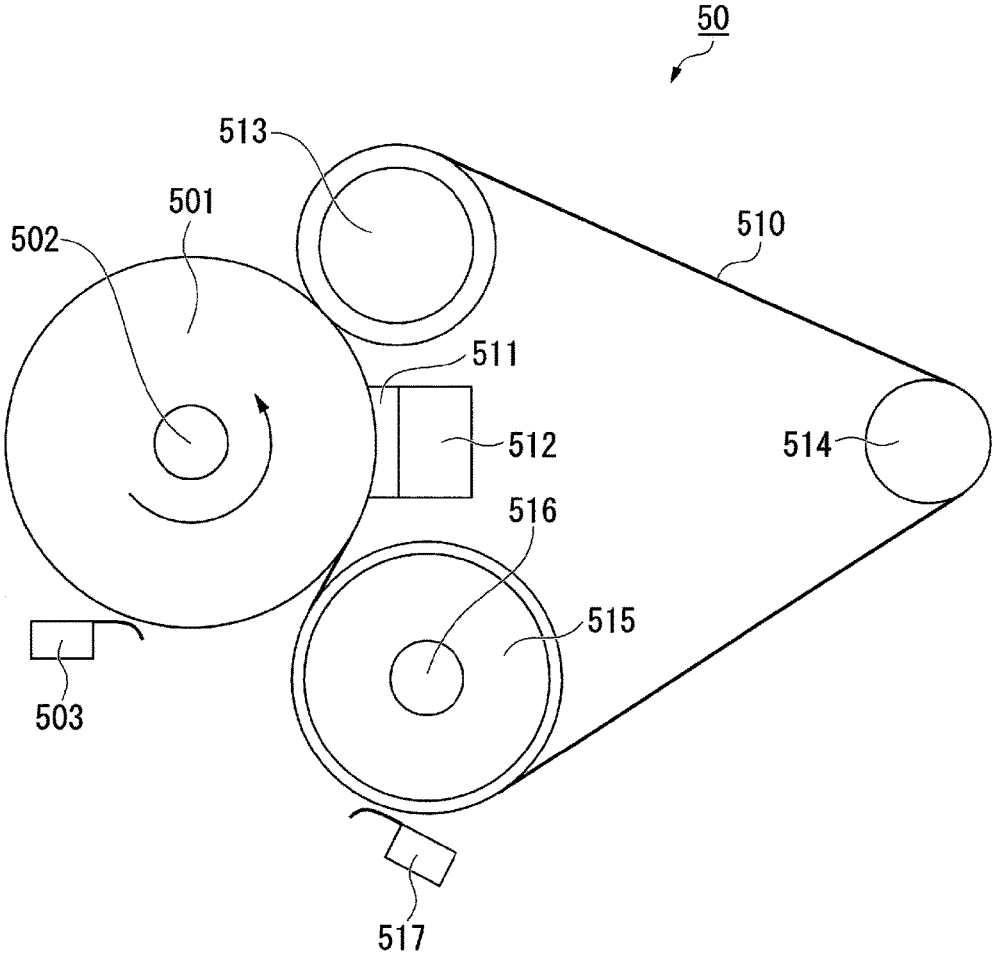
FIG. 2 is a schematic diagram of a fixing section in the image processing apparatus.

FIG. 2 is a schematic diagram of a fixing section 50 included in the printer 130. The fixing section 50 includes a heat roller 501, a heater lamp 502, a thermistor 503, a pressure belt 510, a pressure pad 511, a pad holder 512, a pressure roller 513, a tension roller 514, a belt heating roller 515, a pressure belt lamp 516, and a pressure thermistor 517.

The heat roller 501 is a fixing member formed into a cylindrical shape. The heater lamp 502 is arranged inside the heat roller 501. The heater lamp 502 is a halogen lamp, for example. The heater lamp 502 includes one or a plurality of lamps 523. The heater lamp 502 heats the heat roller 501 as the lamp 523 generates heat. The lamp 523 is described later. The thermistor 503 measures a surface temperature of the heat roller 501.

The pressure belt 510 is rotatably supported by the pressure roller 513, the tension roller 514 and the belt heating roller 515. The heat roller 501 presses the outer peripheral surface of the pressure belt 510 toward the pressure pad 511 so that the inner peripheral surface of the pressure belt 510 is pressed against the pressure pad 511, the pressure roller 513 and the belt heating roller 515. A fixing nip portion is formed between the outer peripheral surface of the pressure belt 510 and the outer peripheral surface of the heat roller 501 through the pressure contact.

The pressure pad 511 is supported in a state of sandwiching the pressure belt 510 in collaboration with the heat roller 501. The pad holder 512 holds the pressure pad 511 in the state that the pressure pad 511 is pressed toward the heat roller 501.

The pressure roller 513 is arranged at the downstream side of the fixing nip portion in a conveyance direction of the sheet. The pressure roller 513 enables the pressure belt 510 to be pressure-contacted with the heat roller 501 in collaboration with the tension roller 514 and the belt heating roller 515. An exit of the fixing nip portion is formed along the pressure roller 513. The tension roller 514 is arranged on the inner side of the pressure belt 510 at a position away from the pressure roller 513 and the belt heating roller 515 to apply tension to the pressure belt 510. The belt heating roller 515 is arranged at the upstream side of the fixing nip portion in a conveyance direction of the sheet. The belt heating roller 515 is formed into a hollow cylindrical shape. The pressure belt lamp 516 is arranged inside the belt heating roller 515. The belt heating roller 515 is heated by the heat generated by the pressure belt lamp 516. The pressure belt lamp 516 is, for example, a halogen lamp. The pressure thermistor 517 measures a surface temperature of the outer peripheral surface of the pressure belt 510 nearby the belt heating roller 515.

Figure 3:
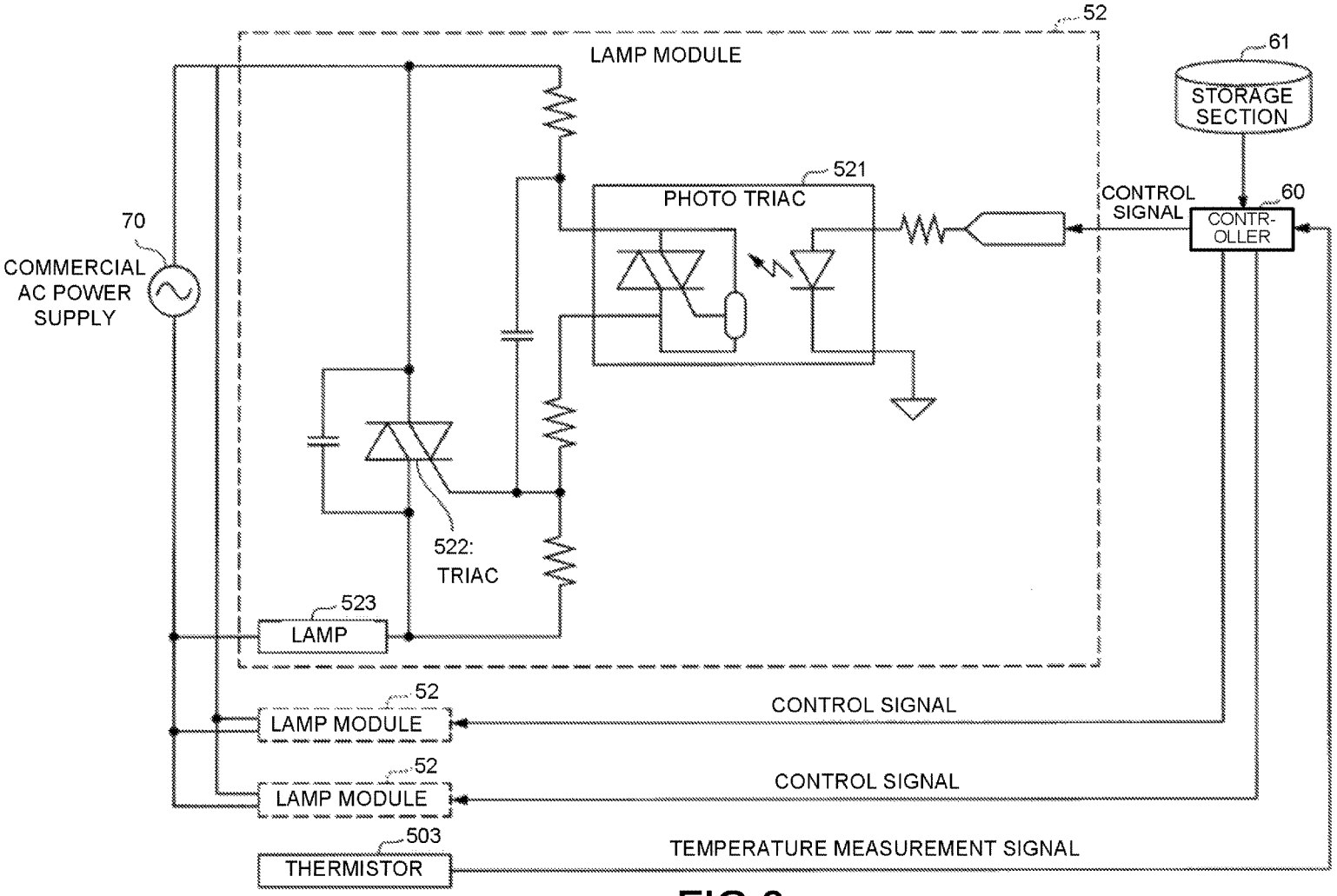
FIG. 3 is a diagram illustrating a specific example of the control circuit of a heater lamp of the image processing apparatus.

FIG. 3 is a schematic diagram of a specific example of the control circuit of the heater lamp 502 of the image processing apparatus 100. In the control circuit of the heater lamp 502, a plurality of lamp modules 52 is formed, for example. Each lamp module 52 includes the lamp 523 as a heat generating element. One or a plurality of lamps 523 forms a heater lamp 502. Each lamp module 52 is connected to the power supply. In the example in FIG. 3, each lamp module 52 is connected to a commercial AC power supply 70. The electric power is supplied to the lamp 523 from the commercial AC power supply 70. A control signal output from a controller 60 is input to the control circuit of the heater lamp 502. The control signal indicates that the lamp 523 is turned on or turned off. In the control circuit, a photo triac 521 is provided. The photo triac 521 controls timing at which the control signal output from the controller 60 controls ON and OFF of the lamp 523 at zero crossing timing of a waveform of the commercial AC power supply 70. The zero crossing timing is a timing when positive-to-negative or negative-to-positive switching is performed. The control of turning ON and OFF of the lamp 523 by the controller 60 is executed at a timing at which the waveform of the commercial AC power supply 70 is zero-crossed by the photo triac 521.

If the control signal indicating ON is output from the controller 60, a triac 522 is turned on at a next zero-cross timing of a waveform of the commercial AC power supply 70, and the electric power is supplied from the commercial AC power supply 70 to the lamp 523. If the control signal indicating OFF is output from the controller 60, the triac 522 is turned off at the next zero-crossing timing of the waveform of the commercial AC power supply 70, and the electric power supply from the commercial AC power supply 70 to the lamp 523 is stopped.

A temperature measurement signal output from the thermistor 503 is input to the controller 60. The temperature measurement signal indicates the result of measurement of a temperature of the vicinity of the outer peripheral surface of the heat roller 501 by the thermistor 503. The controller 60 determines a duty ratio of the lamp 523 based on the measurement result by the thermistor 503. For example, the measurement result of the temperature and the duty ratio of each lamp 523 are associated with each other in advance, and the controller 60 determines the duty ratio according to the measurement result based on the association. The controller 60 then outputs the control signal indicating ON or OFF to the control circuit based on the control pattern according to the determined duty ratio.

Figure 4:
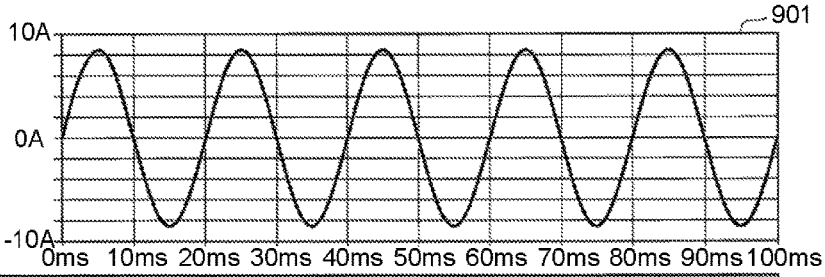
FIG. 4 is a wave form chart and a table of a basic control pattern.

FIG. 4 is a wave form chart and a table of the basic control pattern by the controller 60. In FIG. 4, a reference numeral 901 indicates a specific example of the waveform of the commercial AC power supply 70. A reference numeral 902 indicates a table showing a specific example of the basic control pattern by the controller 60. In the example shown in FIG. 4, a time period corresponding to five periods of the commercial AC power supply 70 is equivalent to one period (hereinafter, referred to as a "pattern period") of the basic control pattern. One basic control pattern includes plural (for example, 10) steps. In the example in FIG. 4, the number of steps included in one basic control pattern is 10. Therefore, in the example in FIG. 4, a time period of the half period of the waveform of the commercial AC power supply 70 is equivalent to one step of the basic control pattern. In the example of the basic control pattern shown in FIG. 4, "0" indicates OFF, and "1" and "−1" indicate ON. "1" indicates ON in the positive polarity and "−1" indicates ON in the negative polarity. In the basic control pattern shown in FIG. 4, a control pattern is defined in 10% increments in a duty control from 0% (OFF) to 100%. For example, at the time the duty control of 10% is executed, the commercial AC power supply 70 is controlled to stop heat generation in the first two periods. The commercial AC power supply 70 is controlled to generate heat from 2 periods to 2.5 periods and is controlled to stop heat generation from 2.5 periods to 5 periods. Through such control, the commercial AC power supply 70 is turned ON for only 0.5 periods among 5 periods corresponding to the pattern period. Therefore, the duty control of 10% is realized.

Figure 5:
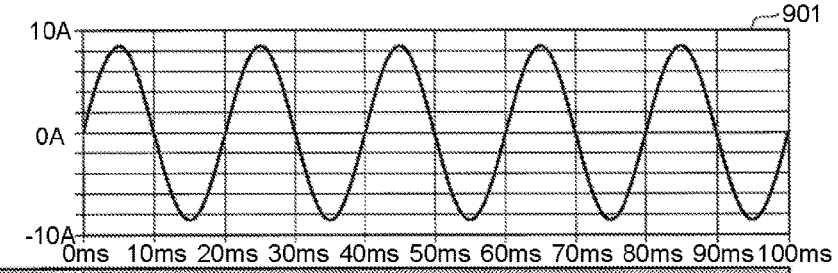
FIG. 5 is a wave form chart and a table of a basic control pattern different from that in FIG. 4.

FIG. 5 is a wave form chart and a table (another specific example) of a control pattern different from the basic control pattern shown in FIG. 4. A reference numeral 902*a* indicates a table showing another specific example of the basic control pattern. In this example, the lighting patterns of 10% and 90%, 20% and 80%, 30% and 70%, 40% and 60% are complementary to each other.

Next, a specific example of a processing by the controller 60 is described. The controller 60 controls ON and OFF of each lamp 523 so that the positive and negative polarities of a power supply current flowing from the commercial AC power supply 70 become more symmetrical. For example, in a case of controlling one lamp 523, the controller 60 performs the control of ON and OFF of the lamp 523 in such a manner that the number of times of ON in the positive polarity and the number of times of ON in the negative polarity are closer. For example, in the case of controlling a plurality of lamps 523 of the same output, the controller 60 performs control in such a manner that a total value of the number of times of turning ON in the positive polarity in each lamp 523 and a total value of the number of times of turning ON in the negative polarity in each lamp 523 are closer. For example, in the case of controlling a plurality of lamps 523 with different output, the controller 60 may perform control by multiplying the number of times by a weighting factor corresponding to the magnitude of the output. Specifically, based on the number of times the weighting factor is multiplied, the controller 60 performs control in such a manner that a total value of the number of times of turning ON in the positive polarity and a total value of the number of times of turning ON in the negative polarity are closer.

Next, a specific control method for realizing the above-described control is described. The controller 60 controls ON and OFF of each lamp 523 based on the control pattern table stored in the storage section 61 and the duty ratio of each lamp 523. The storage section 61 stores a value indicating ON or OFF at each step of each lamp 523 in association with the combination of the duty ratio of each lamp 523. For example, if the heater lamp 502 includes three lamps 523, the storage section 61 stores the control pattern table for each lamp 523 for the combination of the duty ratios of the three lamps 523. FIG. 6 shows a specific example of a control pattern table 903 stored in the storage section 61. The storage section 61 stores the control pattern table as shown in FIG. 6 for each lamp 523 in association with the combination of the duty ratios (for example, 50%, 30% and 60%) of the three lamps 523. If the duty ratio of each lamp 523 is determined, the controller 60 reads out the control pattern table 903 of each lamp 523 according to the combination of the determined duty ratios from the storage section 61. The controller 60 controls ON and OFF of each lamp 523 at each step according to the control pattern table read by the controller 60.

Next, the method of generating the control pattern table stored in the storage section 61 is described. The control pattern table is generated by, for example, the following method which may be executed by, for example, an apparatus that performs pre-processing (for example, a computer).

First, the pre-processing apparatus acquires a plurality of evaluation values relating to a plurality of control patterns. The plurality of the control patterns is ON and OFF control patterns realized by adding a predetermined change to the basic control pattern (refer to FIG. 4 or FIG. 5). For example, a pattern in which all the lamps 523 are controlled according to the basic control pattern without any changes is one control pattern. For example, a pattern in which a part of lamps 523 among the plurality of lamps 523 is controlled by shifting (delaying or advancing) by a half wave length from the basic control pattern is one control pattern. The control of a lamp 523 of 600 watts, a lamp 523 of 600 watts, and a lamp 523 of 300 watts is described as a specific example. Herein after, two lamps of 600 watts are called a first lamp and a second lamp, respectively, and the lamp of 300 watts is called a third lamp.

In this case, for example, the controller 60 may use the following four control patterns for the control of ON and OFF of the lamp 523.

First control pattern (case 1): Control all lamps according to the basic pattern without any changes.

Second control pattern (case 2): Control the first lamp by shifting by the half wave length from the basic pattern. Control the second lamp and the third lamp according to the basic pattern without any changes.

Third control pattern (case 3): Control the second lamp by shifting by the half wave length from the basic pattern. Control the first lamp and the third lamp according to the basic pattern without any changes.

Fourth control pattern (case 4): Control the third lamp by shifting by the half wave length from the basic pattern. Control the first lamp and the second lamp according to the basic pattern without any changes.

The pre-processing apparatus calculates the evaluation value in each control pattern. The evaluation value is a value of an index indicating whether the positive and negative polarities of the power supply current flowing from the commercial AC power supply 70 become nearly symmetrical if the control is performed according to the control pattern. For example, the evaluation value relates to a polarity bias of the power supply current flowing from the commercial AC power supply 70. The evaluation value includes, for example, the following plural values.

Reference evaluation value: a value obtained by multiplying the value indicated by the basic control pattern by a weighting factor and adding the values in the same step of the first lamp to the third lamp. The value of (A) shown in FIG. 7 to FIG. 12.

First evaluation value: an absolute value of the value obtained by adding the reference evaluation values from step 1 to step 10.

Second evaluation value: an absolute value of a difference between the maximum value of the absolute value in the positive polarity and the maximum value of the absolute value in the negative polarity among the reference evaluation values.

Third evaluation value: the larger one of the maximum value of the absolute value in the positive polarity and the maximum value of the absolute value in the negative polarity among the reference evaluation values.

The pre-processing apparatus selects the control pattern actually used based on the obtained evaluation values and a plurality of rules shown below.

First rule: Select the control pattern with the smallest first evaluation value as a candidate.

Second rule: Select the control pattern with the smallest second evaluation value as a candidate.

Third rule: Select the control pattern with the smallest third evaluation value as a candidate.

For example, the pre-processing apparatus may select candidates in the order of the first rule, the second rule and the third rule, and may select that candidate at the time of being limited to one candidate as the control pattern.

Below, a specific combination of the duty ratios of the lamps is described as an application example. A weighting factor of the first lamp and the second lamp is set to "2" and a weighting factor of the third lamp is set to "1". For example, the ratio of the output of each lamp may be used as the weighting factor.

First Application Example

FIG. 7 is a diagram of each control pattern table in the first application example. In this example, the control is performed based on the basic control pattern in FIG. 4. In the first application, the first lamp is controlled at the duty ratio of 80%, the second lamp at the duty ratio of 50%, and the third lamp at the duty ratio of 90%, respectively. In this case, the rule evaluation values (A) in the first control pattern to the fourth control pattern are as shown in the table in FIG. 7. In this case, a first evaluation value (B), a second evaluation value (C), and a third evaluation value (D) in each control pattern are as follows.

The first control pattern: B=11, C=2, D=5

The second control pattern: B=11, C=2, D=5

The third control pattern: B=9, C=2, D=5

The fourth control pattern: B=9, C=2, D=5

In this case, even at the time the determination is made according to the first rule to the third rule, the candidates are not limited to one, and the third control pattern and the fourth control pattern remain as candidates. The pre-processing apparatus may select either the third control pattern or the fourth control pattern. For example, the third control pattern may be selected based on the predetermined rule (a priority is higher in the order from the first to the fourth).

Second Application Example

FIG. 8 is a diagram of each control pattern table in the second application example. In this example, the control is performed based on the basic control pattern in FIG. 4. In the second application example, the first lamp is controlled at the duty ratio of 80%, the second lamp at the duty ratio of 20%, and the third lamp at the duty ratio of 50%. In this case, the reference evaluation values (A) in the first control pattern to the fourth control pattern are as shown in the table in FIG. 8. In this case, the first evaluation value (B), the second evaluation value (C), and the third evaluation value (D) in each control pattern are as follows.

The first control pattern: B=5, C=1, D=5

The second control pattern: B=5, C=1, D=5

The third control pattern: B=5, C=1, D=3

The fourth control pattern: B=5, C=1, D=5

In this case, the candidate is limited to the third control pattern only, at the time the determination is made up to the third rule. Therefore, the pre-processing apparatus selects the third control pattern.

Third Application Example

FIG. 9 is a diagram of each control pattern table in the third application example. In this example, the control is performed based on the basic control pattern in FIG. 4. In the third application, the first lamp is controlled at the duty ratio of 70%, the second lamp at the duty ratio of 30%, and the third lamp at the duty ratio of 60%, respectively. In this case, the reference evaluation values (A) in the first control pattern to the fourth control pattern are as shown in the table in FIG. 9. In this case, the first evaluation value (B), the second evaluation value (C), and the third evaluation value (D) in each control pattern are as follows.

The first control pattern: B=4, C=2, D=5

The second control pattern: B=0, C=0, D=5

The third control pattern: B=0, C=1, D=5

The fourth control pattern: B=4, C=2, D=5

In this case, the candidate is limited to the second control pattern only, at the time the determination is made up to the second rule. Therefore, the pre-processing apparatus selects the second control pattern.

Fourth Application Example

FIG. 10 is a diagram of each control pattern table in the fourth application example. In this example, the control is performed based on the basic control pattern in FIG. 5. In the fourth application, the first lamp is controlled at the duty ratio of 80%, the second lamp at the duty ratio of 50%, and the third lamp at the duty ratio of 90%, respectively. In this case, the reference evaluation values (A) in the first control pattern to the fourth control pattern are as shown in the table in FIG. 10. In this case, the first evaluation value (B), the second evaluation value (C), and the third evaluation value (D) in each control pattern are as follows.

The first control pattern: B=11, C=2, D=5

The second control pattern: B=11, C=2, D=5

The third control pattern: B=9, C=2, D=5

The fourth control pattern: B=9, C=2, D=5

In this case, even if the determination is made according to the first rule to the third rule, the candidates are not limited to one, and the third control pattern and the fourth control pattern remain as candidates. The pre-processing apparatus may select either the third control pattern or the fourth control pattern. For example, the third control pattern may be selected based on the predetermined rule (the priority is higher in the order from the first to the fourth).

Fifth Application Example

FIG. 11 is a diagram of each control pattern table in the fifth application example. In this example, the control is performed based on the basic control pattern in FIG. 5. In the fifth application, the first lamp is controlled at the duty ratio of 70%, the second lamp at the duty ratio of 70%, and the third lamp at the duty ratio of 20%, respectively. In this case, the reference evaluation values (A) in the first control pattern to the fourth control pattern are as shown in the table in FIG. 11. In this case, the first evaluation value (B), the second evaluation value (C), and the third evaluation value (D) in each control pattern are as follows.

The first control pattern: B=4, C=1, D=5

The second control pattern: B=0, C=1, D=5

The third control pattern: B=0, C=1, D=5

The fourth control pattern: B=4, C=1, D=5

In this case, even if the determination is made according to the first rule to the third rule, the candidate is not limited to one, and the second control pattern and the third control pattern remain as candidates. The pre-processing apparatus may select either the second control pattern or the third control pattern. For example, the second control pattern may be selected based on the predetermined rule (the priority is higher in the order from the first to the fourth).

Sixth Application Example

FIG. 12 is a diagram of each control pattern table in the sixth application example. In this example, the control is performed based on the basic control pattern in FIG. 5. In the sixth application example, the first lamp is controlled at the duty ratio of 70%, the second lamp at the duty ratio of 30% and the third lamp at the duty ratio of 50%, respectively. In this case, the reference evaluation values (A) in the first control pattern to the fourth control pattern are as shown in the table in FIG. 12. In this case, the first evaluation value (B), the second evaluation value (C), and the third evaluation value (D) in each control pattern are as follows.

The first control pattern: B=5, C=1, D=3

The second control pattern: B=1, C=1, D=5

The third control pattern: B=9, C=1, D=5

The fourth control pattern: B=5, C=1, D=3

In this case, the candidate is limited to the second control pattern only, at the time the determination is made up to the first rule. Therefore, the pre-processing apparatus selects the second control pattern.

Figure 13:
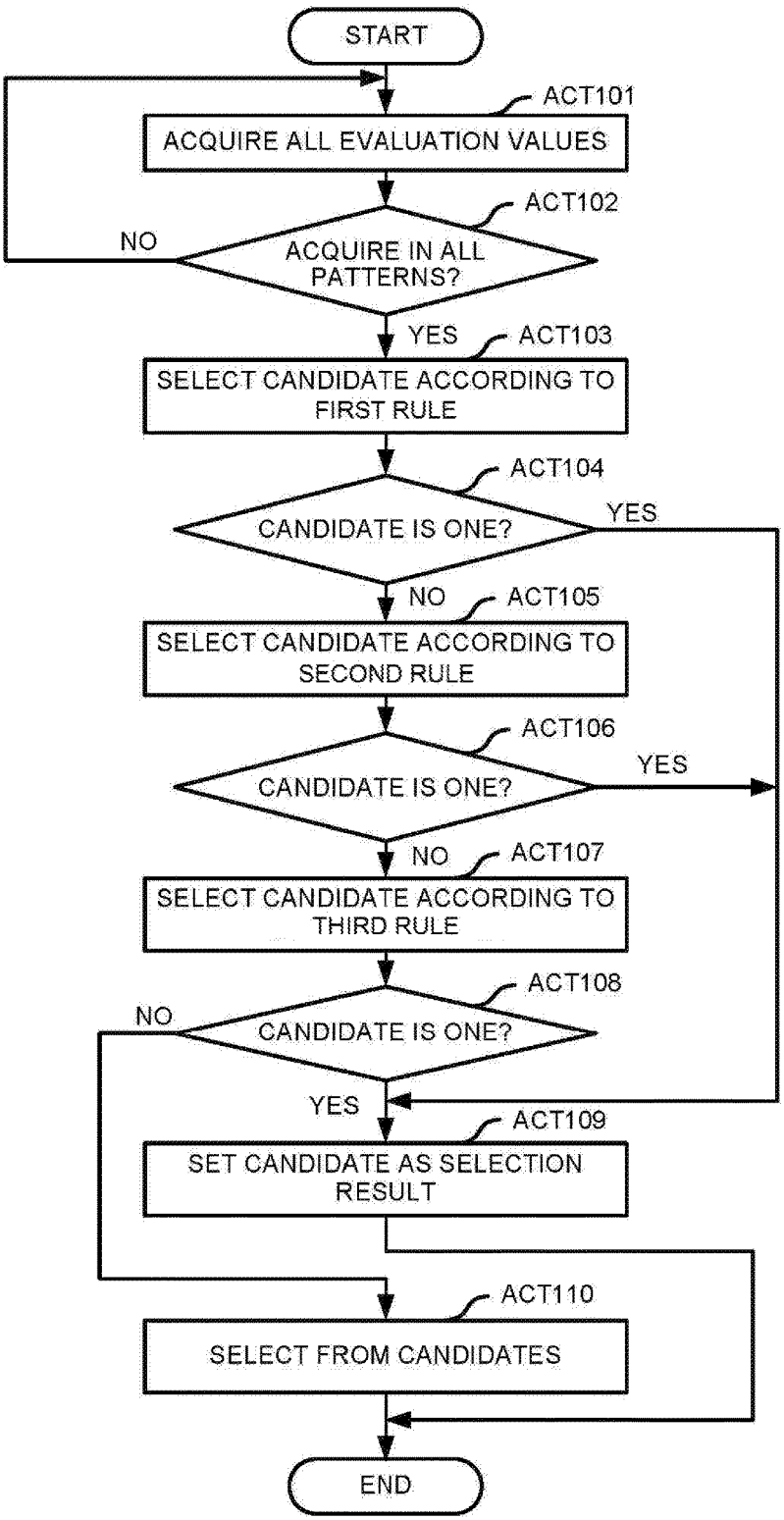
FIG. 13 is a flowchart illustrating a specific example of a method for generating control pattern tables.

FIG. 13 is a flowchart illustrating a specific example of the generation processing executed by the pre-processing apparatus. First, the pre-processing apparatus acquires all the evaluation values in any control pattern (ACT 101). The pre-processing apparatus acquires all the evaluation values in all patterns by executing the processing in ACT 101 with respect to all control patterns (ACT 102). Next, the pre-processing apparatus selects a candidate according to the first rule (ACT 103). If the candidate is limited to one as a result of the selection of ACT 103 (Yes in ACT 104), the pre-processing apparatus selects the candidate as a selection result (ACT 109). If the candidate is not limited to one as a result of the selection of ACT 103 (No in ACT 104), the pre-processing apparatus further selects a candidate according to the second rule among the candidates selected according to the first rule (ACT 105). If the candidate is not limited to one as a result of the selection of ACT 105 (Yes in ACT 106), the pre-processing apparatus further selects the candidate as the selection result (ACT 109). If the candidate is not limited to one as a result of the selection of ACT 105 (No in ACT 106), the pre-processing apparatus further selects candidates according to the third rule from the candidates selected according to the first rule and the second rule (ACT 107). If the candidate is limited to one as a result of the selection of ACT 107 (Yes in ACT 108), the pre-processing apparatus selects the candidate as the selection result (ACT 109). If the candidate is not limited to one as a result of the selection of ACT 107 (No in ACT 108), the pre-processing apparatus selects candidates among the candidates selected according to the first rule, the second rule and the third rule (ACT 110). By executing the above processing (processing in FIG. 13), the control pattern of each lamp 523 is determined for one combination of the duty ratios. The pre-processing apparatus executes the above processing on all combinations of the duty ratios. By such processing, the control pattern table for each lamp 523 is determined for all combinations of the duty ratios.

The controller 60 controls each lamp 523 based on the control pattern table determined by such processing. Therefore, based on the first evaluation value, the second evaluation value and the third evaluation value, the control of each lamp 523 is realized in which a difference between the positive polarity current and the negative polarity current becomes smaller. Therefore, even if the lamp 523 (heat generating element) is controlled at the duty ratio, it is possible to make the amplitude of the higher harmonics wave smaller.

(Modification)

The control pattern table stored in the storage section 61 is not necessarily provided for all combinations of the duty ratios. For example, the control pattern table may be stored only for the combinations of a plurality of the duty ratios selected in advance. In this case, the controller 60 may select the control pattern table of the close duty ratio based on the determined duty ratio.

The storage section 61 for storing the control pattern table of the duty ratio is not necessarily provided. In this case, for example, the controller 60 may generate the control pattern table used by performing the same processing as the pre-processing apparatus based on the determined duty ratio. Then, the controller 60 may control ON and OFF of each lamp 523 based on the generated control pattern table.

The order of the first rule to the third rule used in selecting the control pattern may be any order. For example, the pre-processing apparatus may select candidates in the order of the third rule, the second rule and the first rule, and select that candidate as the control pattern at the time of being limited to one candidate. For example, the pre-processing apparatus may select candidates in the order of the second rule, the third rule and the first rule, and select that candidate as the control pattern at the time of being limited to one candidate.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image processing apparatus, comprising:

a heat roller configured to heat a sheet with heat generated by a plurality of heat generating elements; and a controller configured to control a current supplied to the heat generating elements from an AC power supply, wherein the controller controls a timing at which the current flows to the heat generating elements and a timing at which the current does not flow to the heat generating elements according to a first set of stored control parameters that are selected from a plurality of sets of stored control parameters including the first set of stored control parameters and a second set of stored control parameters, such that a total of a first sum of estimated absolute value magnitudes of a positive polarity current flowing to the heat generating elements during one duty cycle of the heat generating elements and a second sum of estimated absolute value magnitudes of a negative polarity current flowing to the heat generating elements during the one duty cycle, is lower when the heat generating elements are controlled according to the first set of stored control parameters relative when the heat generating elements are controlled according to the second set of stored control parameters.

2. The image processing apparatus according to claim 1, wherein the stored control parameters in each of the first and second sets specify duty ratios for each of the heat generating elements, and the duty ratios specified in the first set of stored control parameters are different from the duty ratios specified in the second set of stored control parameters.

3. The image processing apparatus according to claim 2, wherein the magnitude of the positive polarity current for the heat generating elements and the magnitude of the negative polarity current for the heat generating elements are estimated at each discrete time step during the duty cycle.

4. The image processing apparatus according to claim 3, wherein each of the heat generating elements has a weighting factor corresponding to electric power consumption rating of the heat generating element, and the magnitude of the positive polarity current for the heat generating elements during a discrete time step is estimated by adding up the weighting factors for all of the heat generating elements that are turned ON in the positive polarity during the discrete time step, and the magnitude of the negative polarity current for the heat generating elements during a discrete time step is estimated by adding up the weighting factors for all of the heat generating elements that are turned ON in the negative polarity during the discrete time step.

5. The image processing apparatus according to claim 1, wherein the total is smallest when the heat generating elements are controlled according to the first set of stored control parameters relative to when the heat generating elements are controlled according to the all other sets of stored control parameters.

6. An image processing apparatus, comprising:

a heat roller configured to heat a sheet with heat generated by a heat generating element; and a controller configured to control a current supplied to the heat generating element from an AC power supply, wherein the controller controls a timing at which the current flows to the heat generating elements and a timing at which the current does not flow to the heat generating elements according to a first set of stored control parameters that are selected from a plurality of sets of stored control parameters including the first set of stored control parameters and a second set of stored control parameters, such that a difference between a maximum of estimated absolute value magnitudes of a positive polarity current flowing to the heat generating elements during one duty cycle of the heat generating elements and a maximum of estimated absolute value magnitudes of a negative polarity current flowing to the heat generating elements during the one duty cycle, is lower when the heat generating elements are controlled according to the first set of stored control parameters relative when the heat generating elements are controlled according to the second set of stored control parameters.

7. The image processing apparatus according to claim 6, wherein the stored control parameters in each of the first and second sets specify duty ratios for each of the heat generating elements, and the duty ratios specified in the first set of stored control parameters are different from the duty ratios specified in the second set of stored control parameters.

8. The image processing apparatus according to claim 7, wherein the magnitude of the positive polarity current for the heat generating elements and the magnitude of the negative polarity current for the heat generating elements are estimated at each discrete time step during the duty cycle.

9. The image processing apparatus according to claim 8, wherein each of the heat generating elements has a weighting factor corresponding to electric power consumption rating of the heat generating element, and the magnitude of the positive polarity current for the heat generating elements during a discrete time step is estimated by adding up the weighting factors for all of the heat generating elements that are turned ON in the positive polarity during the discrete time step, and the magnitude of the negative polarity current for the heat generating elements during a discrete time step is estimated by adding up the weighting factors for all of the heat generating elements that are turned ON in the negative polarity during the discrete time step.

10. The image processing apparatus according to claim 6, wherein the difference is smallest when the heat generating elements are controlled according to the first set of stored control parameters relative to when the heat generating elements are controlled according to the all other sets of stored control parameters.

11. An image processing apparatus, comprising:

a heat roller configured to heat a sheet with heat generated by a plurality of heat generating elements; and a controller configured to control a current supplied to the heat generating elements from an AC power supply, wherein the controller controls a timing at which the current flows to the heat generating elements and a timing at which the current does not flow to the heat generating elements according to a first set of stored control parameters that are selected from a plurality of sets of stored control parameters including the first set of stored control parameters and a second set of stored control parameters, such that a maximum of estimated absolute value magnitudes of a positive polarity current flowing to the heat generating elements during one duty cycle of the heat generating elements and estimated absolute value magnitudes of a negative polarity current flowing to the heat generating elements during the one duty cycle, is lower when the heat generating elements are controlled according to the first set of stored control parameters relative when the heat generating elements are controlled according to the second set of stored control parameters.

12. The image processing apparatus according to claim 11, wherein the stored control parameters in each of the first and second sets specify duty ratios for each of the heat generating elements, and the duty ratios specified in the first set of stored control parameters are different from the duty ratios specified in the second set of stored control parameters.

13. The image processing apparatus according to claim 12, wherein the magnitude of the positive polarity current for the heat generating elements and the magnitude of the negative polarity current for the heat generating elements are estimated at each discrete time step during the duty cycle.

14. The image processing apparatus according to claim 13, wherein each of the heat generating elements has a weighting factor corresponding to electric power consumption rating of the heat generating element, and the magnitude of the positive polarity current for the heat generating elements during a discrete time step is estimated by adding up the weighting factors for all of the heat generating elements that are turned ON in the positive polarity during the discrete time step, and the magnitude of the negative polarity current for the heat generating elements during a discrete time step is estimated by adding up the weighting factors for all of the heat generating elements that are turned ON in the negative polarity during the discrete time step.

15. The image processing apparatus according to claim 11, wherein the maximum is smallest when the heat generating elements are controlled according to the first set of stored control parameters relative to when the heat generating elements are controlled according to the all other sets of stored control parameters.

* * * * *